US009564708B2

(12) United States Patent
Endo et al.

(10) Patent No.: US 9,564,708 B2
(45) Date of Patent: Feb. 7, 2017

(54) ELECTRICAL CONNECTOR

(71) Applicant: DAI-ICHI SEIKO CO., LTD., Kyoto (JP)

(72) Inventors: Takayoshi Endo, Shizuoka (JP); Sakai Yagi, Shizuoka (JP); Shuji Touno, Shizuoka (JP); Hiroyuki Kurita, Shizuoka (JP)

(73) Assignee: DAI-ICHI SEIKO CO., LTD. (JP)

( * ) Notice: Subject to any disclaimer, the term of this patent is extended or adjusted under 35 U.S.C. 154(b) by 0 days.

(21) Appl. No.: 15/044,958

(22) Filed: Feb. 16, 2016

(65) Prior Publication Data

US 2016/0248198 A1 Aug. 25, 2016

(30) Foreign Application Priority Data

Feb. 19, 2015 (JP) ..... 2015-030888

(51) Int. Cl.
*H01R 13/627* (2006.01)

(52) U.S. Cl.
CPC ..... *H01R 13/6272* (2013.01)

(58) Field of Classification Search
CPC . H01R 13/6272; H01R 13/502; H01R 13/514; H01R 13/4365; H01R 13/506; H01R 13/641
USPC ..... 439/352
See application file for complete search history.

(56) References Cited

U.S. PATENT DOCUMENTS 6,419,515 B1 7/2002 Okayasu ..... 439/358
6,679,719 B2 * 1/2004 Endo ..... H01R 13/641 439/352
6,918,783 B2 * 7/2005 Endo ..... H01R 13/6272 439/352
7,201,599 B2 * 4/2007 Holub ..... H01R 13/506 439/352
7,267,570 B2 * 9/2007 Fry, Jr. ..... H01R 13/6272 439/357
7,387,545 B2 * 6/2008 Tyler ..... H01R 13/4365 439/595
7,503,793 B2 * 3/2009 Morello ..... H01R 13/6272 439/352
7,559,787 B2 * 7/2009 Shigeta ..... H01R 13/6272 439/358
8,043,106 B1 * 10/2011 Morello ..... H01R 13/6272 439/352

(Continued)

FOREIGN PATENT DOCUMENTS

JP 61-60481 4/1986 ..... H01R 13/639
JP 3534013 3/2004 ..... H01R 13/639

(Continued)

*Primary Examiner* — Jean F Duverne
(74) *Attorney, Agent, or Firm* — Hayes Soloway P.C.

(57) ABSTRACT

An electrical connector including: a housing including an outer peripheral part; and a lock arm provided with the outer peripheral part. The lock arm is swingable like a seesaw and detachably engages with a locking part provided with another housing of a mating connector. The lock arm extends along a coupling direction toward the mating connector. A pair of side wall parts are provided with the outer peripheral part such that the pair of side wall parts oppose to each other from both sides of the lock arm. An elastic support mechanism for swingably supporting the lock arm is provided between a lower face part of the lock arm and inner side faces of the pair of side wall parts.

4 Claims, 22 Drawing Sheets

(56) References Cited

U.S. PATENT DOCUMENTS

| | | | | |
|---|---|---|---|---|
| 8,435,047 | B2 * | 5/2013 | Patel | H01R 13/514<br>439/532 |
| 9,318,836 | B2 * | 4/2016 | Yagi | H01R 13/502 |
| 2005/0181653 | A1 | 8/2005 | Shimizu et al. | 439/310 |

FOREIGN PATENT DOCUMENTS

| | | | |
|---|---|---|---|
| JP | 2005-209407 | 8/2005 | H01R 13/639 |
| JP | 2012-129077 | 5/2012 | H01R 13/639 |

* cited by examiner

ELECTRICAL CONNECTOR

BACKGROUND OF THE INVENTION

1. Field of the Invention

The present invention relates to an electrical connector provided with a locking mechanism. The electrical connector is used as an electrically connecting means for electric wires transmitting electric signals.

2. Description of the Related Art

In a certain kind of electrical connector, a housing thereof is provided with a lock arm. The lock arm swings like a seesaw. A locking part is provided in another housing of a mating connector. The lock arm detachably engages with the locking part. The electrical connector shown in from FIG. 17 to FIG. 23 belongs to this kind.

As shown in FIG. 17 and FIG. 18, in a conventional electrical connector 500, a lock arm 502 swingable like a seesaw is provided with an outer peripheral part of a housing 501. The lock arm 502 can engage with a locking part 602 provided with another housing 601 of a mating connector 600.

As shown in FIG. 19 and FIG. 20, a pair of side wall parts 504 and 504 are erected from an outer peripheral part 501*a* of the housing 501. The lock arm 502 is arranged between the pair of side wall parts 504 and 504. The lock arm 502 is connected to the outer peripheral part 501*a* of the housing 501 with a pair of leg parts 503. That is, the lock arm 502 and the housing 501 are integrally formed. The pair of leg parts 503 and 503 correspond to fulcrums of the lock arm 502. When the leg parts 503 and 503 are elastically bent, the lock arm 502 swings about the leg parts 503 and 503 utilizing thereof as fulcrums.

As shown in FIG. 18, when the electrical connector 500 and the mating connector 600, which are separated from each other, are moved in a coupling direction X to make them couple with each other, a locking part 502*b* of the lock arm 502 (of the electrical connector 500) abuts on the locking part 602 of the mating connector 600, and runs over it while sliding thereon. After that, the locking part 502*b* of the lock arm 502 fits into the reverse side of the locking part 602. In this way, the electrical connector 500 and the mating connector 600 are locked together.

As shown in FIG. 17, an operating part 502*a* of the lock arm 502 is located at a reverse side of the housing 501. The locking part 502*b* is located at a reverse side of the operating part 502*a*. As shown in FIG. 21 and FIG. 22, when the operating part 502*a* is pressed toward the housing 501, the lock arm 502 swings like a seesaw utilizing the pair of leg parts 503 and 503 as fulcrums. As a result, the locking part 502*b* moves in a direction away from the outer peripheral part 501*a*. If the pressing to the operating part 502*a* is released, the lock arm 502 returns to an original state (a state shown in FIG. 17 and FIG. 20) according to elastic restoring force of the leg parts 503 and 503.

When the electrical connector 500 and the mating connector 600 shown in FIG. 18 are coupled with each other and the operating part 502*a* of the lock arm 502 is pressed toward the housing 501, the locking part 502*b* is released (as shown in FIG. 21 and FIG. 22) from the outer peripheral part 501*a* of the housing 501, and the electrical connector 500 and the mating connector 600 can be separated from each other.

Reference 1 (Japan Registered Patent No. 3534013) and Reference 2 (Japanese patent application Laid-open on No. 2012-129077) disclose electrical connectors of the same kind.

A "connector" in Reference 1 is provided with a lock arm _40 swingable like a seesaw about a fulcrum part _42 similar to the lock arm 502 of the connector 500 shown in FIG. 17 (See, paragraph "0012" and FIG. 1 of Reference 1.).

Another "connector" in Reference 2 is also provided with a lock arm _34 including an arm body _36 swingable like a seesaw, or the like utilizing a leg part _35 as a fulcrum (See, paragraph "0020", FIG. 3, and FIG. 4. of Reference 2).

There is demand for making the electrical connector as low as possible. In response to the demand, a method of shortening the leg parts 503 and 503 of the electrical connector 500 shown in FIG. 17 to approximate the lock arm 502 to the housing 501 may be taken in some cases.

Since the leg parts 503 and 503 work as fulcrums when the lock arm 502 swings, the bending moment concentrates on the leg parts 503 and 503. If the leg parts 503 and 503 are shortened, the leg parts 503 and 503 can be hardly bent and the load concentrates upon narrow regions of the leg parts 503 and 503 (especially, roots thereof). Therefore, stress concentration may easily cause plastic deformation of the leg parts 503 and 503.

As a result, the leg parts 503 and 503 cannot return to original positions thereof any more.

As shown in FIG. 23, the following phenomenon (so-called "settling of a lock arm") may occur. That is, the leg parts 503 and 503 do not return to their original standing postures, and the lock arm 502 keeps inclined even after external force has been released. Once the "settling of the lock arm" has occurred, when the electrical connector 500 and the mating connector 600 are tried to connect to each other, locking therebetween must become imperfect. Unfortunately, the electrical connector 500 may come out from the mating connector 600 (See, FIG. 18).

It is predicted that such a phenomenon may occur in the same way according to the "connectors" of References 1 and 2. The conventional electrical connectors cannot resolve this problem.

LIST OF CITED REFERENCES

Reference 1: Japan Registered Patent No. 3534013
Reference 2: Japanese patent application Laid-open on No. 2012-129077

SUMMARY OF THE INVENTION

In view of the above, an object of the present invention is to provide an electrical connector capable of preventing from the settling of the lock arm even if the electrical connector is formed lower.

A first aspect of the present invention provides an electrical connector, comprising: a housing including an outer peripheral part; and a lock arm provided with the outer peripheral part, the lock arm being swingable like a seesaw and detachably engaging with a locking part provided with another housing of a mating connector, wherein: the lock arm extends along a coupling direction toward the mating connector; a pair of side wall parts are provided with the outer peripheral part such that the pair of side wall parts oppose to each other from both sides of the lock arm; and an elastic support mechanism for swingably supporting the lock arm is provided between a lower face part of the lock arm and inner side faces of the pair of side wall parts.

With this structure, the elastic support mechanism provided with between the lower face part of the lock arm and the inner side faces of the pair of side wall parts is lined up as an elastically deformable portion and fulcrums when the lock arm swings like a seesaw. Even if the electrical connector is formed lower, stress concentration caused by shortening the elastically deformable portion is avoided and the settling of the lock arm is also prevented. Furthermore, the lock arm is operable to be released very easily.

A second aspect of the present invention provides, in addition to the first aspect, wherein the elastic support mechanism includes: a bridge part capable of being elastically deformed, the bridge part being provided between the outer peripheral part of the housing and the lock arm so as to connect the pair of side wall parts; and a leg part connecting the lock arm and the bridge part.

With this structure, the bridge part and the leg part are lined up as elastically deformable portions and fulcrums when the lock arm swings like a seesaw. Even if the electrical connector is formed lower, stress concentration caused by shortening the elastically deformable portion is avoided and the settling of the lock arm is also prevented. Furthermore, the lock arm is operable to be released very easily.

Preferably, a plurality of leg parts are provided with the electrical connector. This arrangement enables to stabilize the posture of the lock arm upon the releasing operation thereof. Thereby, the releasing operation can be more preferably performed.

A third aspect of the present invention provides, in addition to the first aspect, wherein the elastic support mechanism includes: a projection piece capable of being elastically deformed, the projection piece being provided between the outer peripheral part of the housing and the lock arm so as to project from one of the inner side faces of the pair of side wall parts; and a leg part connecting the lock arm and the projection piece.

With this structure, the projection piece and the leg part are lined up as an elastically deformable portion and a fulcrum when the lock arm swings like a seesaw. Even if the electrical connector is formed lower, stress concentration caused by shortening the elastically deformable portion is avoided and the settling of the lock arm is also prevented. Furthermore, the lock arm is operable to be released very easily.

According to the present invention, releasing operation of the lock arm can be preferably performed. Even if the electrical connector is formed lower, the settling of the lock arm hardly occurs, and the electrical connector does not carelessly separate from the mating connector.

Figure 1:
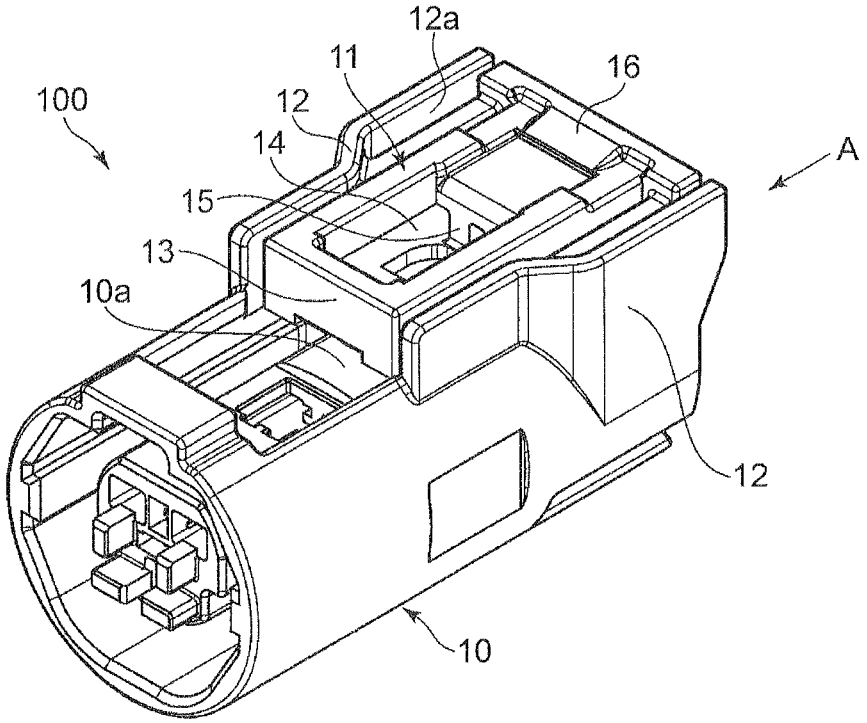
FIG. 1 is a perspective view of an electrical connector in Embodiment 1 according to the present invention.

DETAILED DESCRIPTION OF THE PREFERRED EMBODIMENTS (Embodiment 1)

Embodiments of the present invention are now described with reference to the accompanying drawings.

The subject-matter of the present invention concerns neither an internal structure of a housing 10 of an electrical connector 100 nor an internal structure of a housing 20 of a mating connector 200. In other words, the scope of the present invention is not limited to illustrated internal structures, which can be arbitrarily changed. For example, although the electrical connector 100 and the mating connector 200 couples with each other, the electrical connector 100 may be either of a male type and a female type. Hereinafter, referring to from FIG. 1 to FIG. 8, the electrical connector 100 in Embodiment 1 according to the present invention will now be explained.

Directions with respect to the electrical connector 100 are defined as follows. That is, a "front" face side (a "front" side) means a side that couples with the mating connector 200, and a "reverse" side (a "back" side) is an opposite side of the "front" face side by 180 degrees. An "upper" side means a side on which a lock arm 11 is provided, and a "lower" side means an opposite side of the "upper" side by 180 degrees.

Directions with respect to the mating connector 200 are defined as follows. That is, a "front" face side (a "front" side) means a side that couples with the electrical connector 100, and a "reverse" side (a "back" side) means an opposite side of the "front" face side by 180 degrees. An "upper" side means a side on which a locking part 21 is provided, and a "lower" side means an opposite side of the "upper" side by 180 degrees.

As shown in from FIG. 1 to FIG. 6, the electrical connector 100 in this Embodiment includes the following members. As shown in FIG. 1, a pair of side wall parts 12 and 12 are provided with an outer peripheral part 10*a* of the housing 10 in a coupling direction X toward the mating connector 200. A constant width is opened between the side wall parts 12 and 12.

Figure 5:
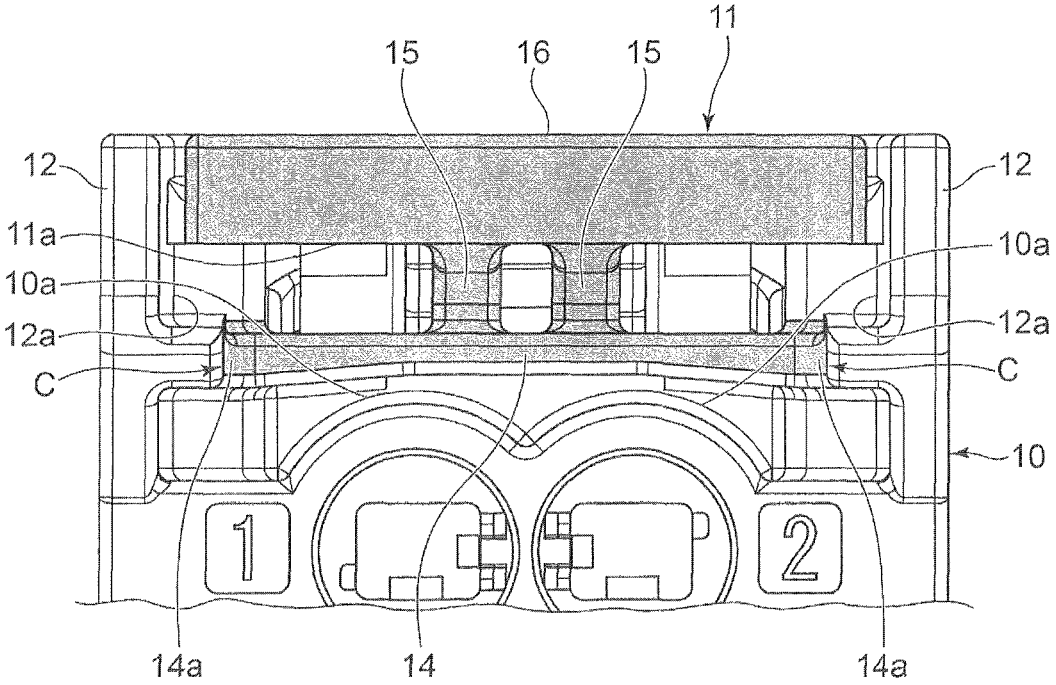
FIG. 5 is a partially enlarged view of FIG. 3.
Figure 6:
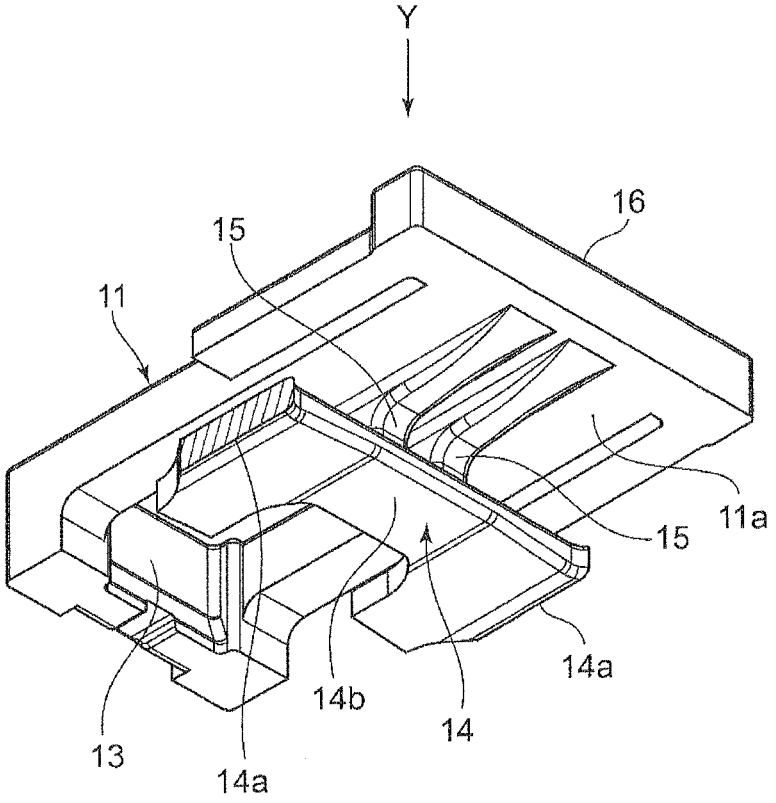
FIG. 6 is a perspective view of a lock arm in Embodiment 1 according to the present invention.

As shown in a grayed portion of FIG. 5 and FIG. 6, a lock arm unit is formed operable to be separated from the housing 10, and is swingably attached between the pair of side wall parts 12 and 12.

The lock arm unit includes: the lock arm 11; a bridge part 14 whose distal end 14*a* being engaged with the pair of side wall parts 12 and 12; and a plurality of leg parts 15 and 15 connecting a lower face part 11*a* of the lock arm 11 to a proximal end of the bridge part 14.

The lock arm 11 includes the following elements. An operating part 16 corresponds to an effort of a seesaw, and is located at an opposite side of the mating connector 200. A swing part 13 corresponds to a load of the seesaw, and detachably engages with the locking part 21 of the mating connector 200. The leg parts 15 and 15 and the bridge part 14 correspond to a fulcrum of the seesaw. When the operating part 16 is pressed downward to make the swing part 13 swing upward, the bridge part 14 and the leg parts 15 and 15 are elastically deformed.

In the electrical connector 100, the bridge part 14 and the plurality of leg parts 15 and 15 are provided between the lower face part 11*a* of the lock arm 11 and inner side faces 12*a* and 12*a* of the side wall parts 12 and 12. The provided members work as an elastic support mechanism for swingably supporting the lock arm 11.

As shown in FIG. 6, a lock arm unit in Embodiment 1 is configured as follows. That is, the lock arm unit is in a shape of a widened letter of "II" in a view from the back side shown in FIG. 6. That is, in Embodiment 1, the bridge part 14 is connected together with a bottom part 14*b*. The plurality of leg parts 15 and 15 are continuously-provided at an opposite side (on a surface opposing to the lock arm 11) of the bottom part 14*b*.

Figure 7:
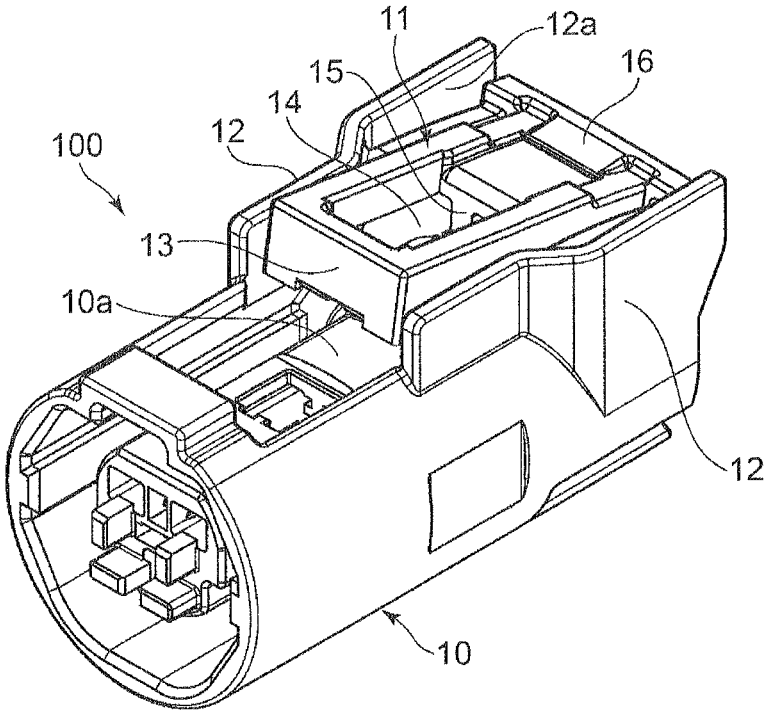
FIG. 7 is a perspective view of the electrical connector in Embodiment 1 according to the present invention (lock-arm inclined)
Figure 8:
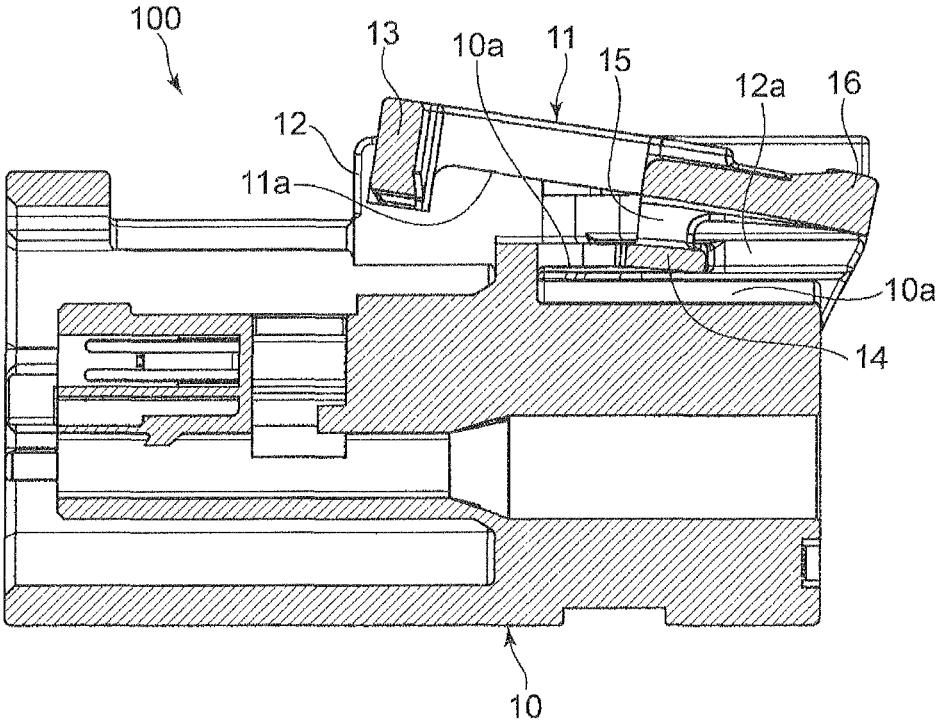
FIG. 8 is a longitudinal sectional view of FIG. 7.

As shown in FIG. 7 and FIG. 8, the bridge part 14 and the leg parts 15 and 15 are elastically deformable. Therefore, if pressing force is applied onto the operating part 16 of the lock arm 11 or is released, the lock arm 11 swings like a seesaw utilizing the bridge part 14 and the leg parts 15 and 15 as fulcrums thereof. Due to this motion, the swing part 13 of the lock arm 11 is separated from the outer peripheral part 10*a* of the housing 10, or returns to an original position thereof. When upward pressing force is applied to the lower face of the swing part 13 of the lock arm 11 or is released, the lock arm 11 also swings like a seesaw.

Figure 2:
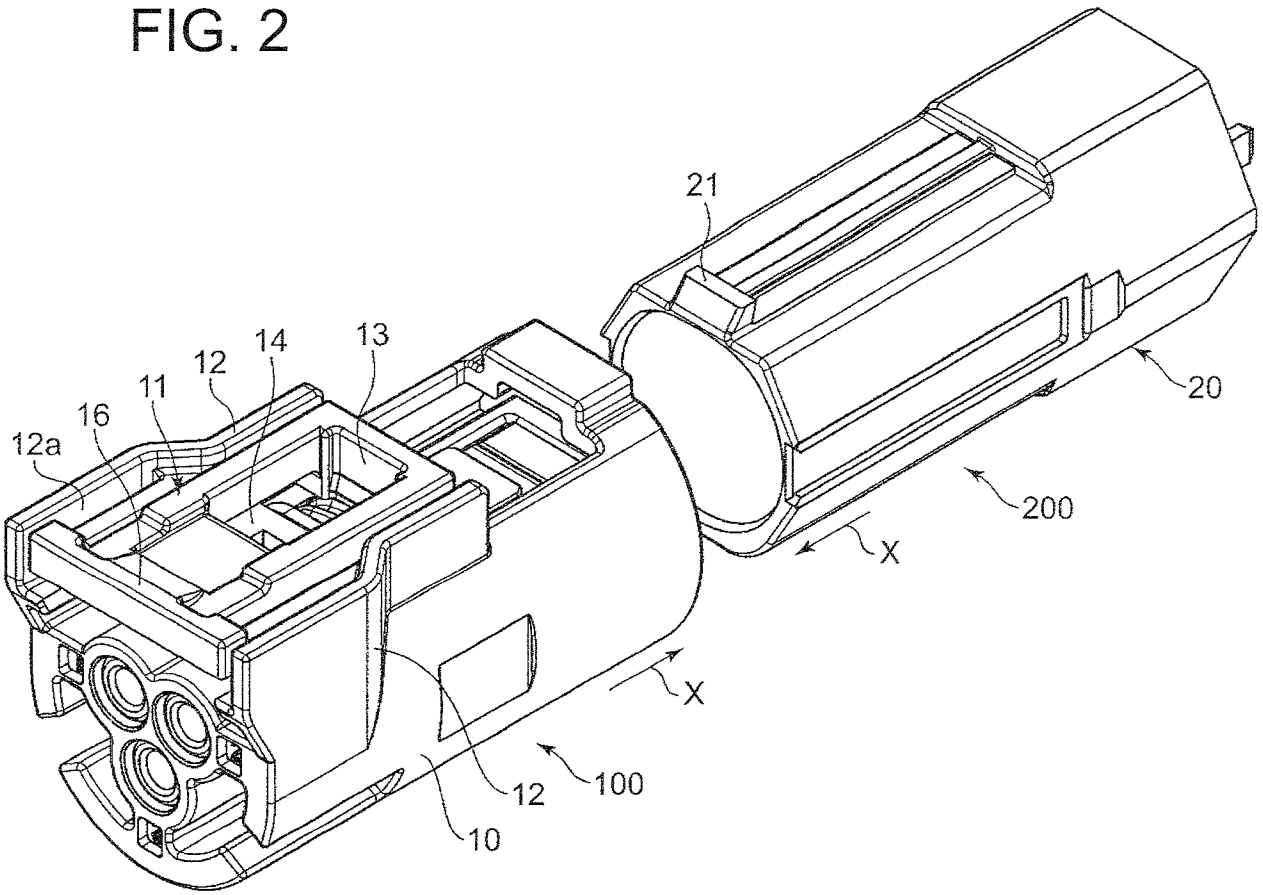
FIG. 2 is a perspective view of both the electrical connector in Embodiment 1 according to the present invention and a mating connector.
Figure 3:
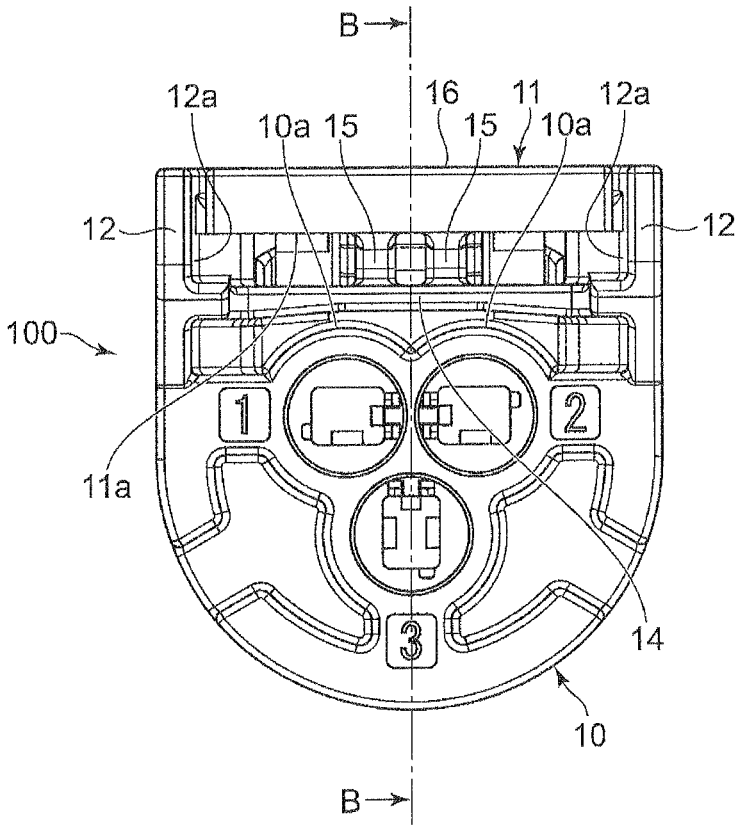
FIG. 3 is a rear view of the electric connector by arrow A in FIG. 1.
Figure 4:
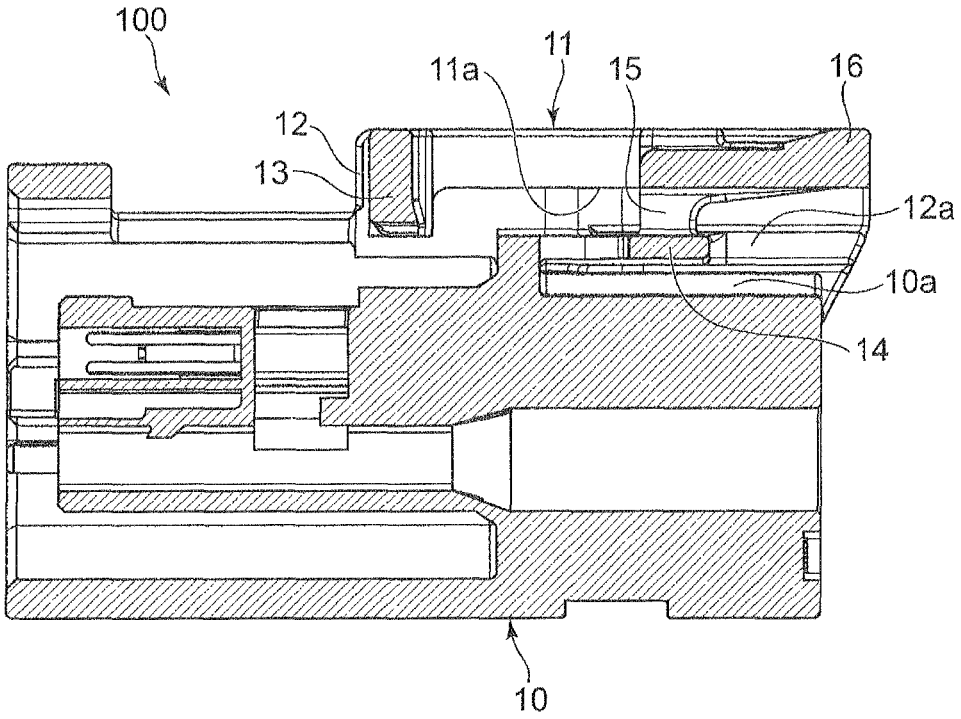
FIG. 4 is a sectional view by B-B line of FIG. 3.

As shown in FIG. 2, when the electrical connector 100 and the mating connector 200, which are separated from each other, are moved in the coupling direction X to make them couple with each other, the swing part 13 of the lock arm 11 (of the electrical connector 100) abuts on the locking part 21 of the mating connector 200, and runs over it while sliding thereon. After that, the swing part 13 of the electrical connector 100 fits into the reverse side of the locking part 21 of the mating connector 200. In this way, the electrical connector 100 and the mating connector 200 are locked together.

On the other hand, as shown in FIG. 7 and FIG. 8, when the operating part 16 of the lock arm 11, which is located in the reverse side of the housing 10 of the electrical connector 100, is pressed toward the housing 10, the lock arm 11 swings like a seesaw utilizing the portions of the bridge part 14, and the leg parts 15 and 15 as fulcrums, and the swing part 13, which is located at a opposite position of the operating part 16, moves away from the outer periphery part 10*a* of the housing 10. When the pressing to the operating part 16 is released, the lock arm 11 returns to the original state (a state shown in FIG. 1 and FIG. 4) according to elastic restoring force of the bridge part 14 and the leg parts 15 and 15.

Accordingly, when the electrical connector 100 and the mating connector 200 shown in FIG. 2 are coupled with each other and the operating part 16 of the lock arm 11 is pressed toward the housing 10, the swing part 13 of the lock arm 11 is released (as shown in FIG. 7 and FIG. 8) from the outer peripheral part 10*a* of the housing 10, and the electrical connector 100 and the mating connector 200 can be separated from each other.

According to the structure in the electrical connector 100 shown in from FIG. 1 to FIG. 8, even if the leg parts 15 and 15 are shortened so as to form the electrical connector 100 lower, the leg parts 15 and 15 and the bridge part 14 can be secured as a portion for elastically deforming as a fulcrum when the lock arm 11 swings like a seesaw. Therefore, stress concentration resulting from the shortening of the elastic deformation portion can be avoided, and settling of the lock arm can be also prevented.

When the lock arm 11 swings like a seesaw, not only the leg parts 15 and 15 but also the bridge part 14 can be elastically deformed while being twisted. Excellent release operation of the lock arm 11 can be maintained, and this is also effective in preventing from the settling of the lock arm.

(Embodiment 2)

Next, referring to from FIG. 9 to FIG. 16, an electrical connector 300 in Embodiment 2 according to the present invention will now be explained.

Embodiment 2 will be explained focusing on different points from Embodiment 1. In other words, points without specific explanation are the same as those of Embodiment 1.

Figure 9:
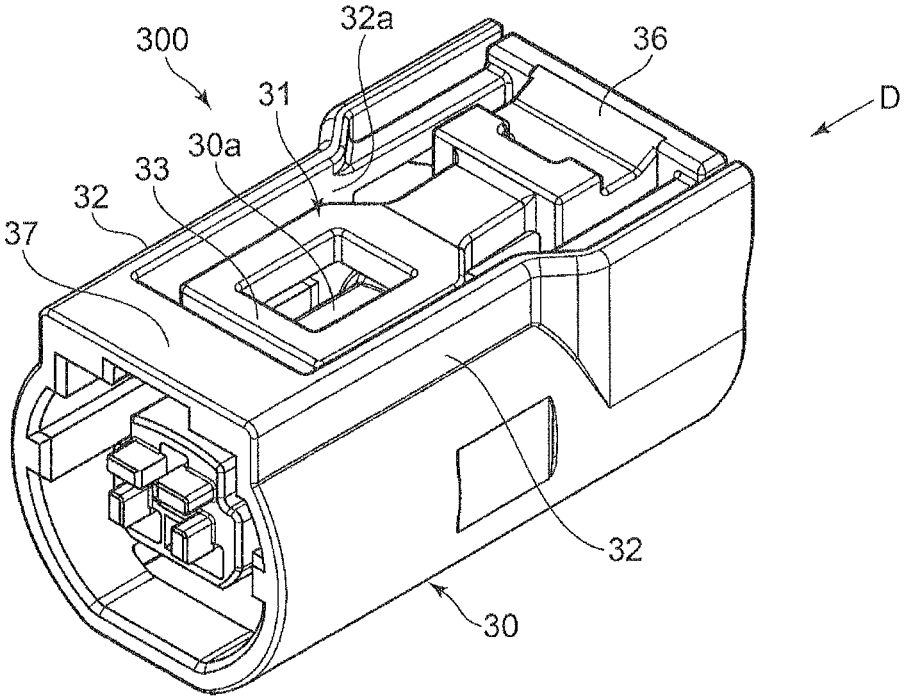
FIG. 9 is a perspective view of an electrical connector in Embodiment 2 according to the present invention.

As shown in from FIG. 9 to FIG. 16, the electrical connector 300 in this Embodiment includes the following members. As shown in FIG. 9, a pair of side wall parts 32 and 32 are provided with an outer peripheral part 30*a* of a housing 30 along a coupling direction X toward a mating connector 400. A constant width is opened between the side wall parts 32 and 32.

Figure 12:
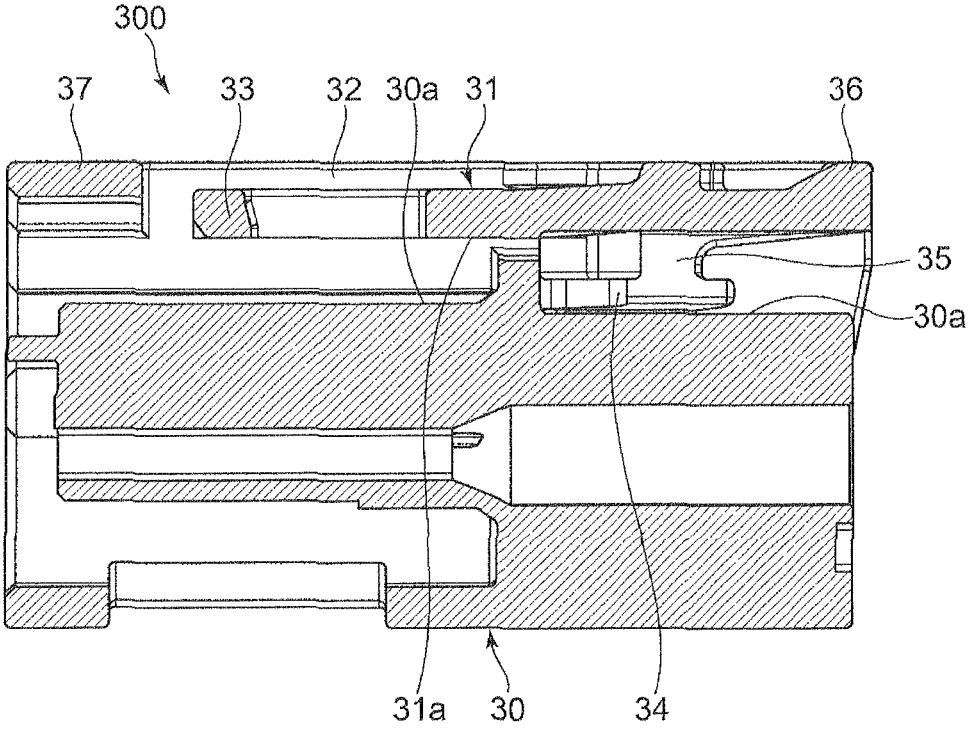
FIG. 12 is a sectional view by E-E line of FIG. 11.
Figure 14:
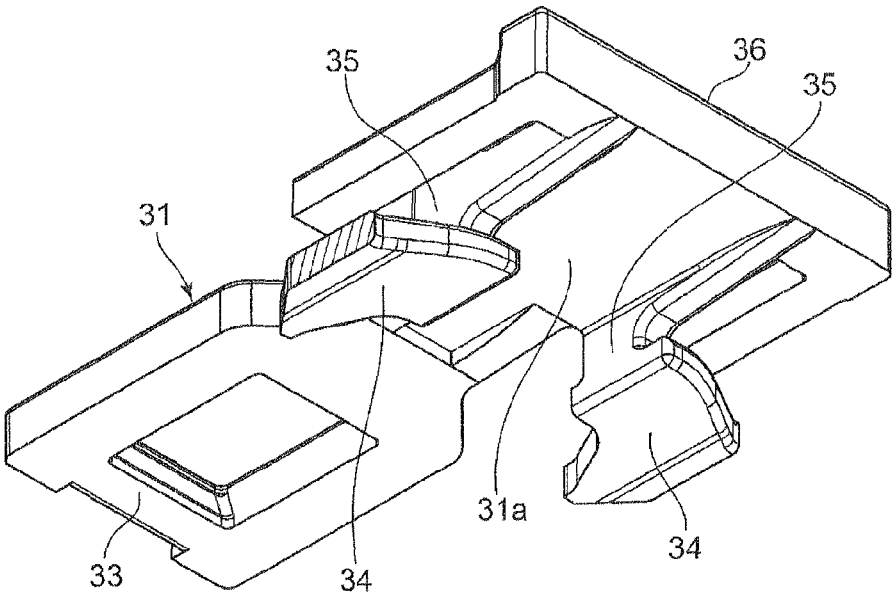
FIG. 14 is a perspective view of a lock arm in Embodiment 2 according to the present invention.

As shown in a grayed portion of FIG. 12 and FIG. 14, a lock arm unit is formed operable to be separated from the housing 30, and is swingably attached between the pair of side wall parts 32 and 32. The lock arm unit includes: a lock arm 31; a pair of projection pieces 34 and 34 including distal ends engaged with the pair of side wall parts 32 and 32; a plurality of leg parts 35 and 35 connecting a lower face part 31*a* of the lock arm 31 and proximal ends of the pair of projection pieces 34 and 34.

The lock arm 31 includes the following members. An operating part 36 corresponds to an effort of a seesaw, and is located in an opposite side of the mating connector 400. The swing part 13 corresponds to a load of the seesaw, and detachably engages with a locking part 41 of the mating connector 400. The leg parts 35 and 35 and the pair of projection pieces 34 and 34 correspond to fulcrums of the seesaw. When the operating part 36 is pressed downward to make a locking part 33 swing upward, the pair of projection pieces 34 and 34 and the leg parts 35 and 35 are elastically deformed.

In the electrical connector 300, the pair of projection pieces 34 and 34 and the plurality of leg parts 35 and 35 are provided between the lower face part 31*a* of the lock arm 31 and inner side faces 32*a* and 32*a* of the side wall parts 32 and 32. The provided members work as an elastic support mechanism for swingably supporting the lock arm 31.

Figure 11:
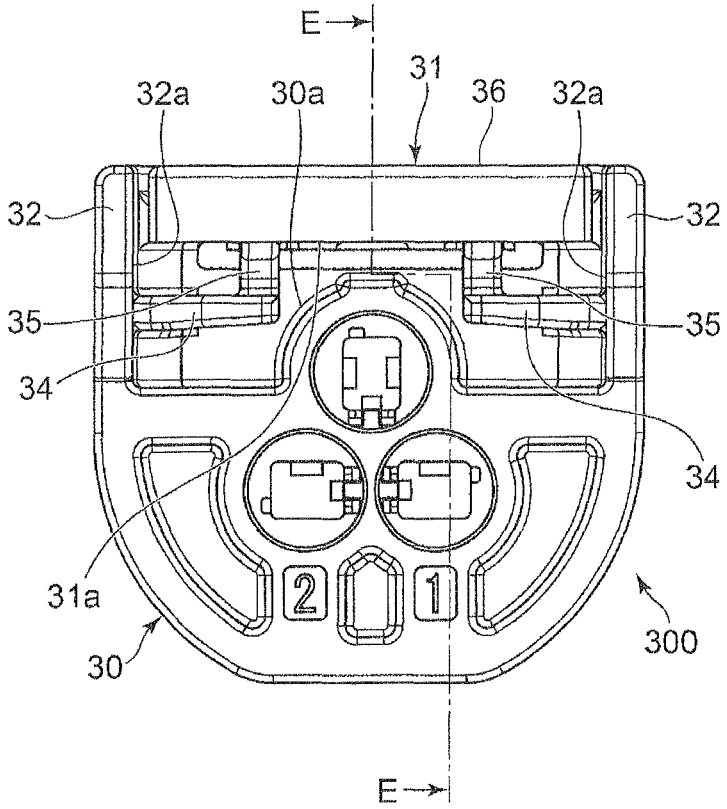
FIG. 11 is a rear view of the electrical connector by arrow D of FIG. 9.
Figure 13:
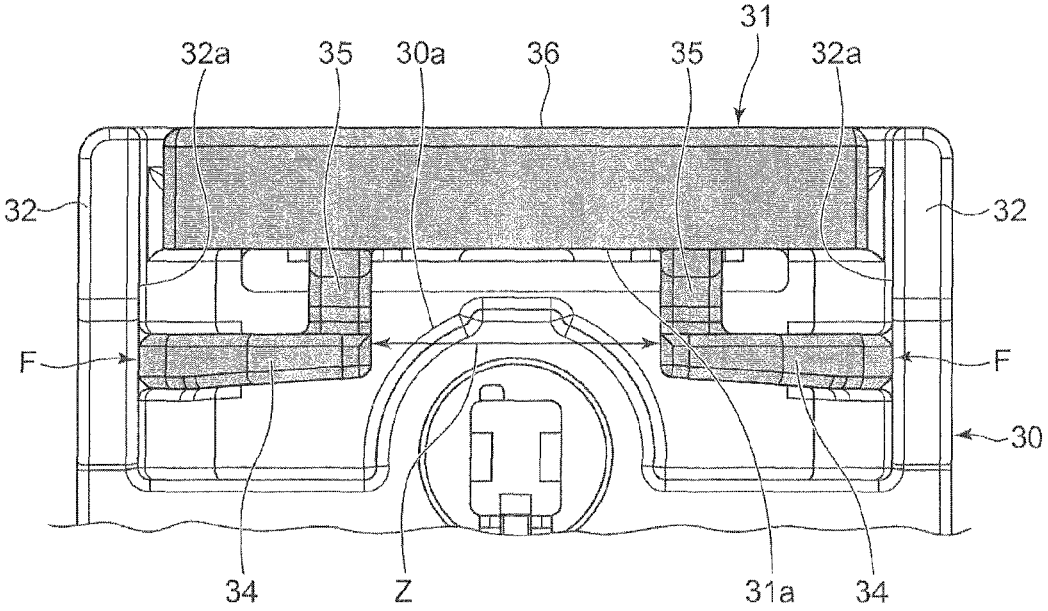
FIG. 13 is a partially enlarged view of FIG. 11.

As shown in FIG. 11 and FIG. 13, a lock arm unit in Embodiment 2 is configured as follows. That is, being surrounded by the inner side faces 32*a* and 32*a* of the side wall parts 32 and 32 and the lower face part 31*a* of the lock arm 31, a set of the pair of projection pieces 34 and 34 and the leg parts 35 and 35 is in a shape of a letter of "π" in back view. The pair of projection pieces 34 and 34 and the leg parts 35 and 35 are arranged near the lower face part 31*a* of the lock arm 31 at a predetermined distance Z. In short, as shown in FIG. 14, in Embodiment 2, dissimilar to Embodiment 1, the projection pieces 34 and 34 are separated from each other. A front face part of the pair of side wall parts 32 and 32 is integrally connected with a bridge part 37 formed near the front face of the housing 30.

Figure 15:
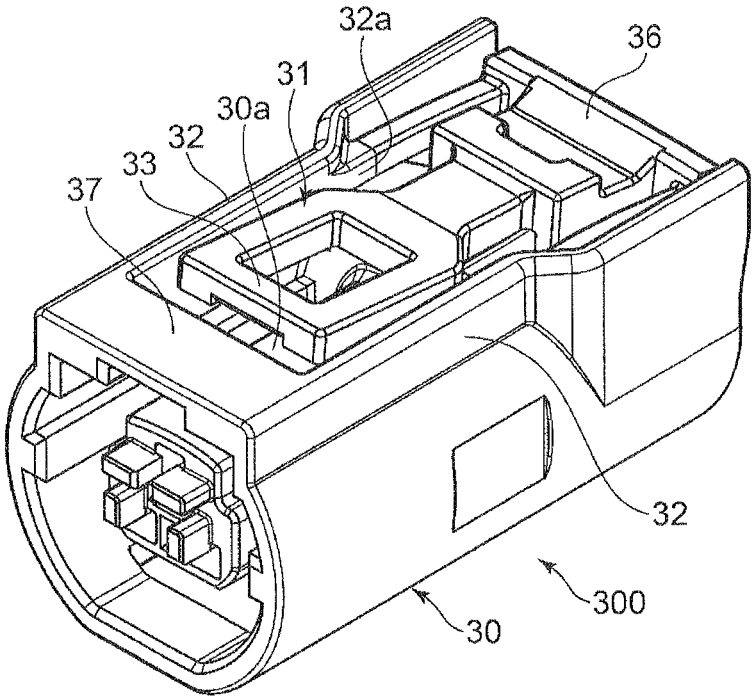
FIG. 15 is a perspective view of the electrical connector in Embodiment 2 according to the present invention (lock-arm inclined)
Figure 16:
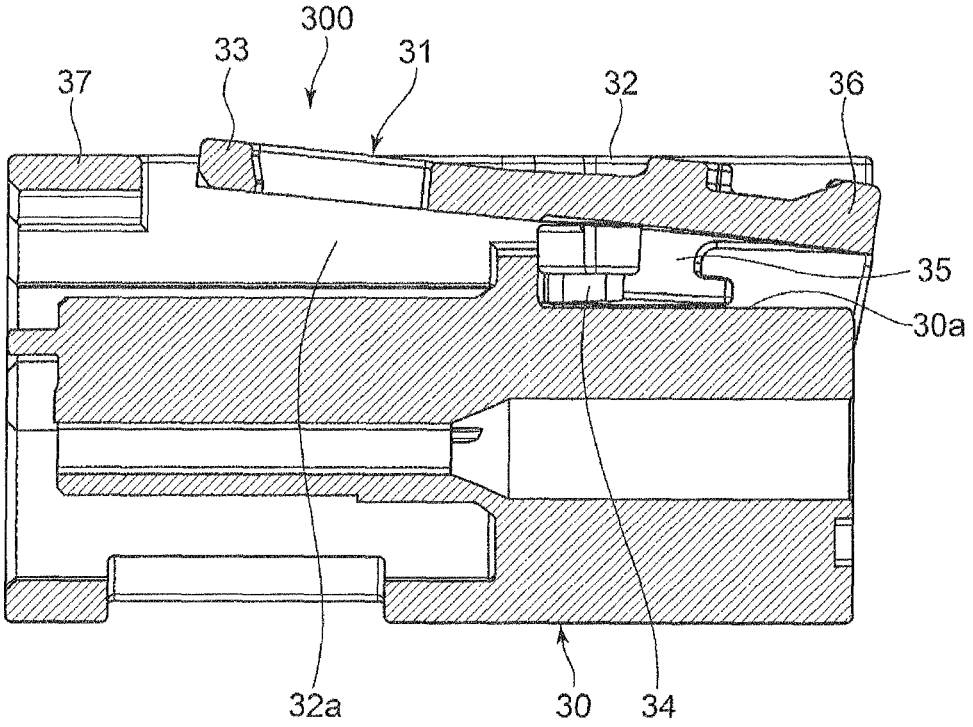
FIG. 16 is a longitudinal sectional view of FIG. 15.
Figure 17:
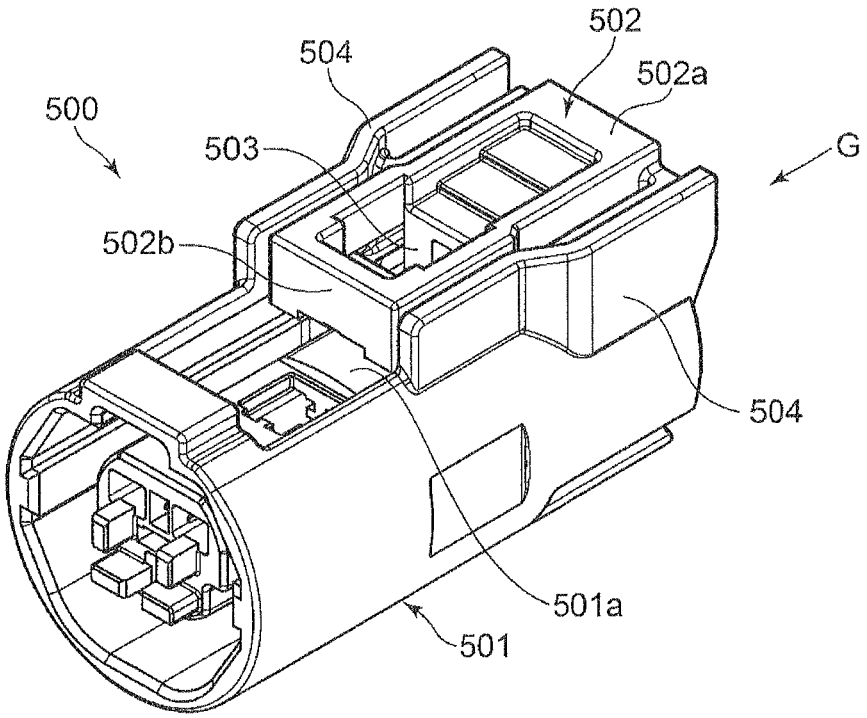
FIG. 17 PRIOR ART
FIG. 17 is a perspective view of a conventional electrical connector.
Figure 18:
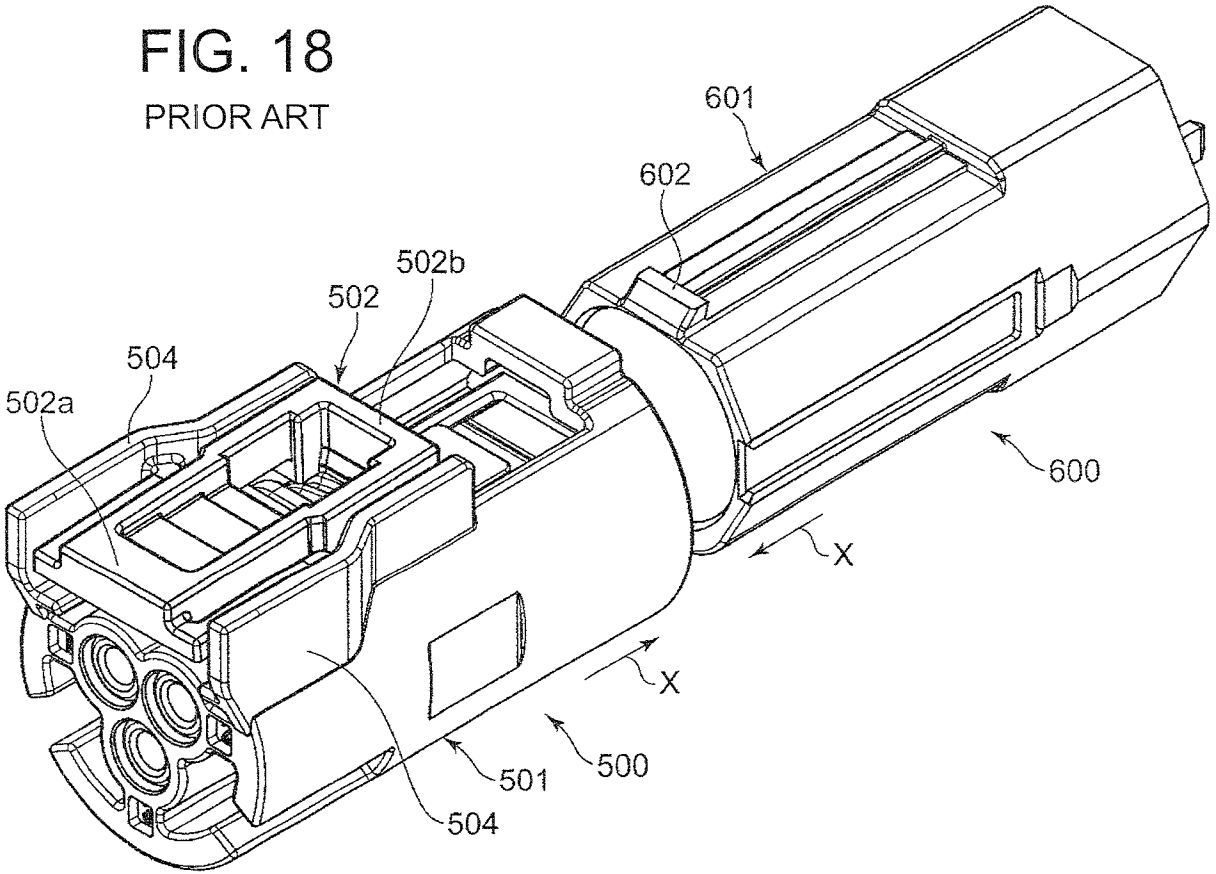
FIG. 18 PRIOR ART
FIG. 18 is a perspective view of both the conventional electrical connector and a mating connector.
Figure 19:
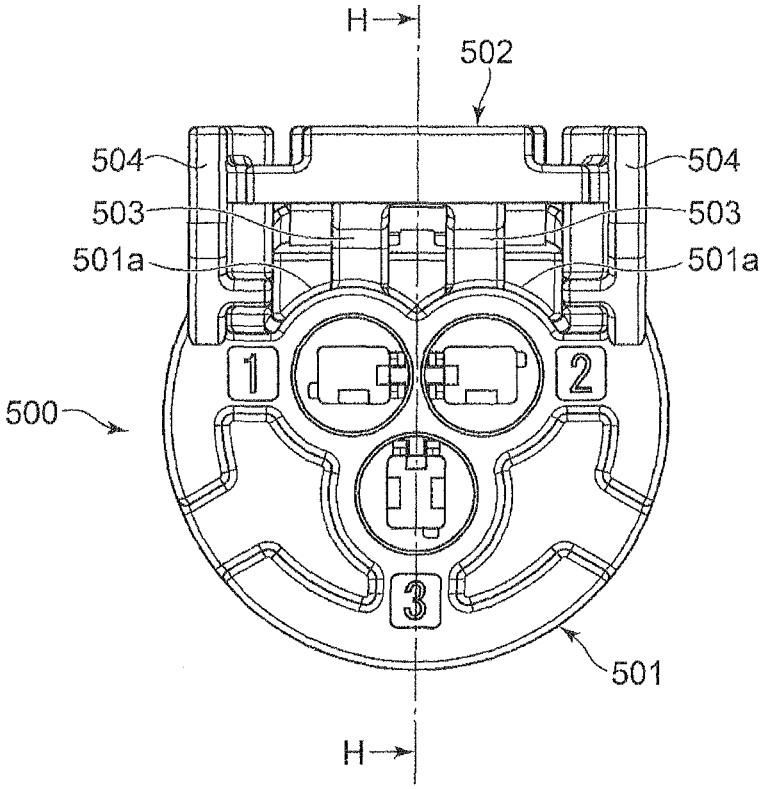
FIG. 19 PRIOR ART
FIG. 19 is a rear view of the electrical connector by arrow G of FIG. 17.
Figure 20:
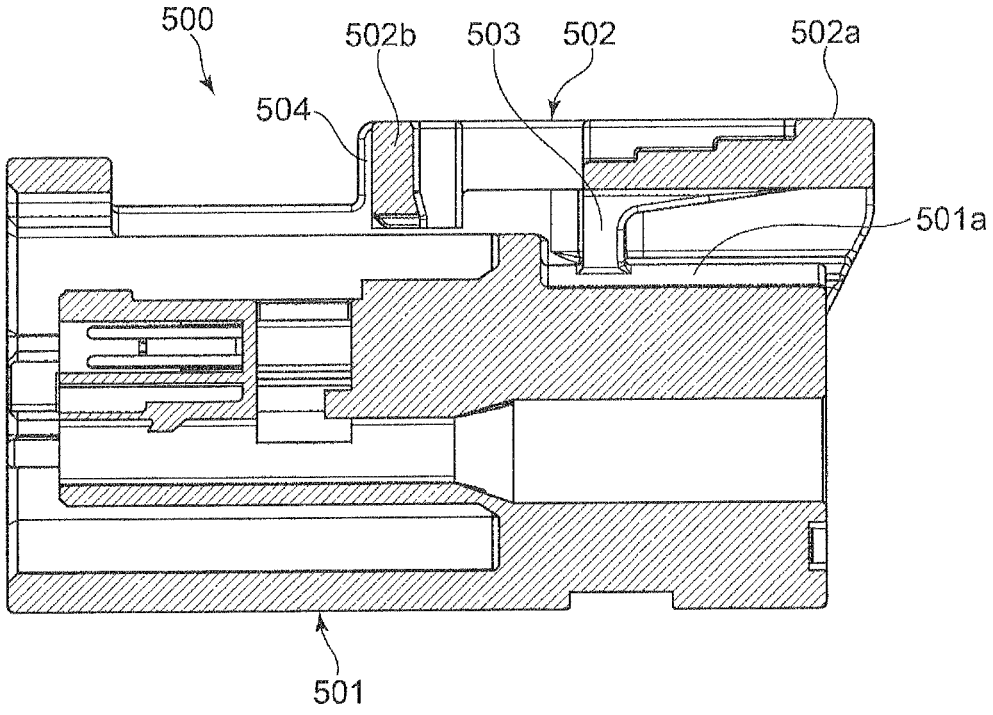
FIG. 20 PRIOR ART
FIG. 20 is a sectional view by H-H line of FIG. 19 (lock-arm not inclined)
Figure 21:
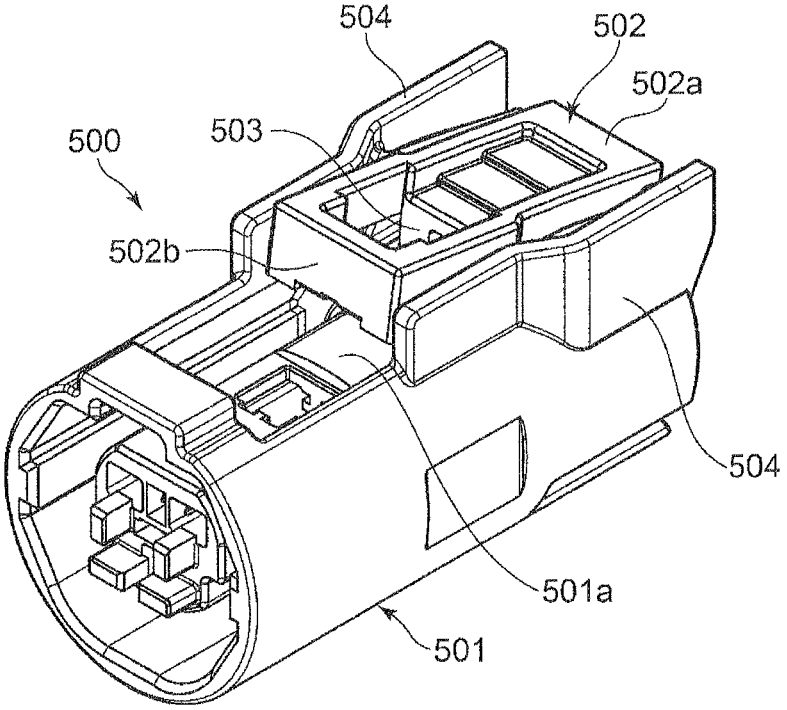
FIG. 21 PRIOR ART
FIG. 21 is a perspective view of the conventional electrical connector (lock-arm inclined)
Figure 22:
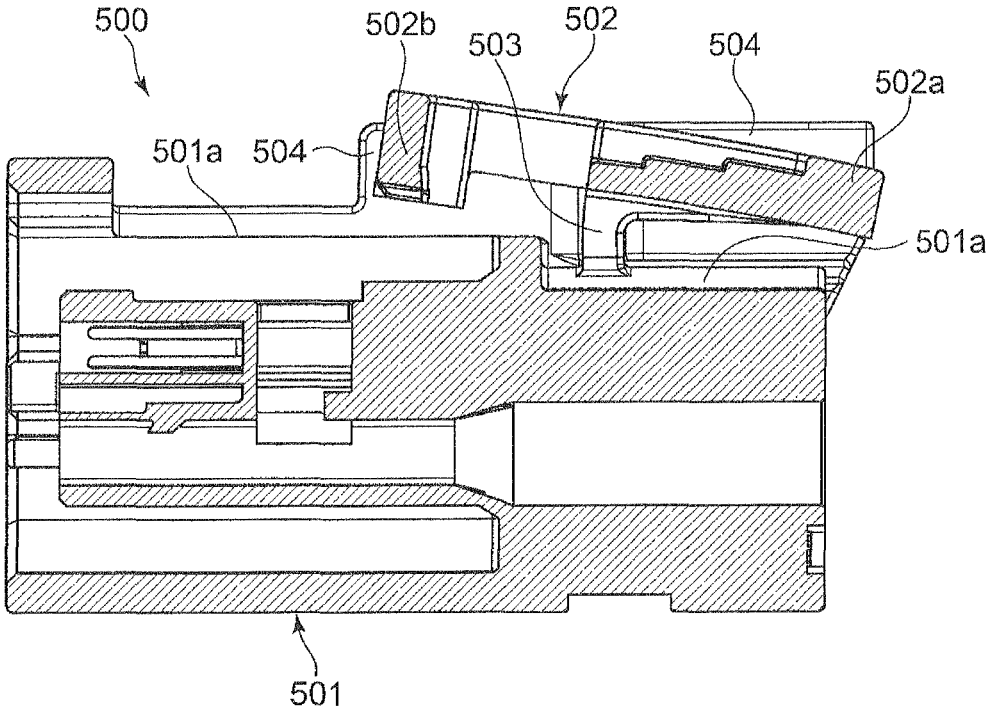
FIG. 22 PRIOR ART
FIG. 22 is a sectional view by H-H line of FIG. 19 (lock-arm inclined)
Figure 23:
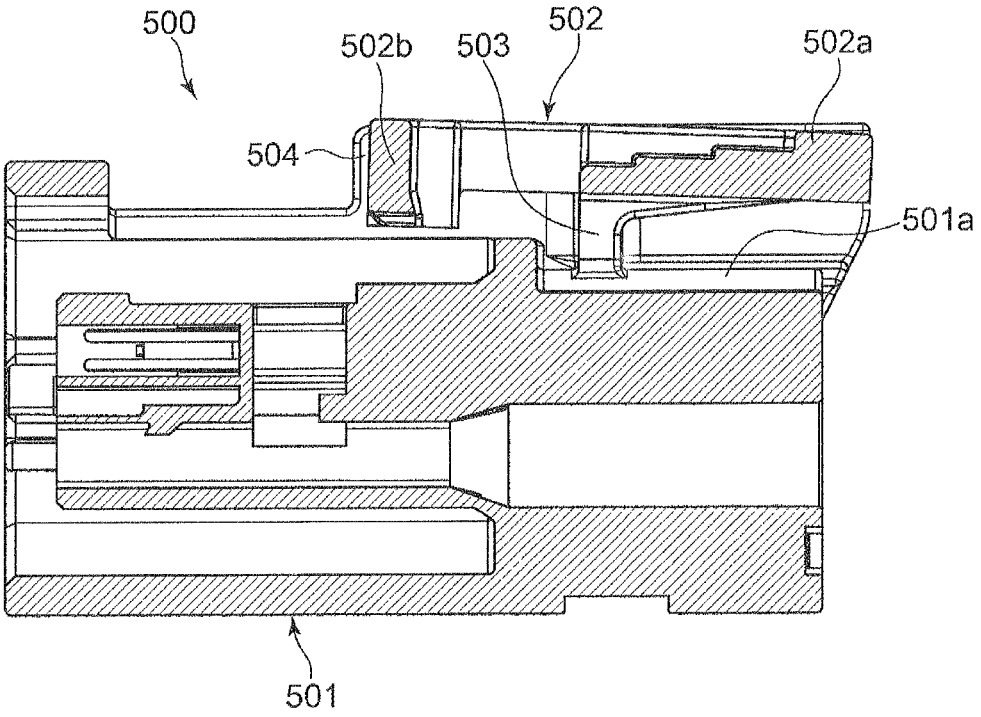
FIG. 23 PRIOR ART
FIG. 23 is a perspective view of the conventional electric connector (lock-arm instable).

As shown in FIG. 15 and FIG. 16, the pair of projection pieces 34 and 34 and the leg parts 35 and 35 can be elastically deformed. If pressing force is applied onto the operating part 36 of the lock arm 31 or is released, the lock arm 31 swings like a seesaw utilizing the portions of the pair of projection pieces 34 and 34 and the leg parts 35 and 35 as fulcrums thereof. Due to this motion, the locking part 33 of the lock arm 31 is separated from the outer peripheral part 30*a* of the housing 30, or returns to an original position thereof. When upward pressing force is applied to the lower face of the locking part 33 of the lock arm 31 or is released, the lock arm 31 also swings like a seesaw.

Figure 10:
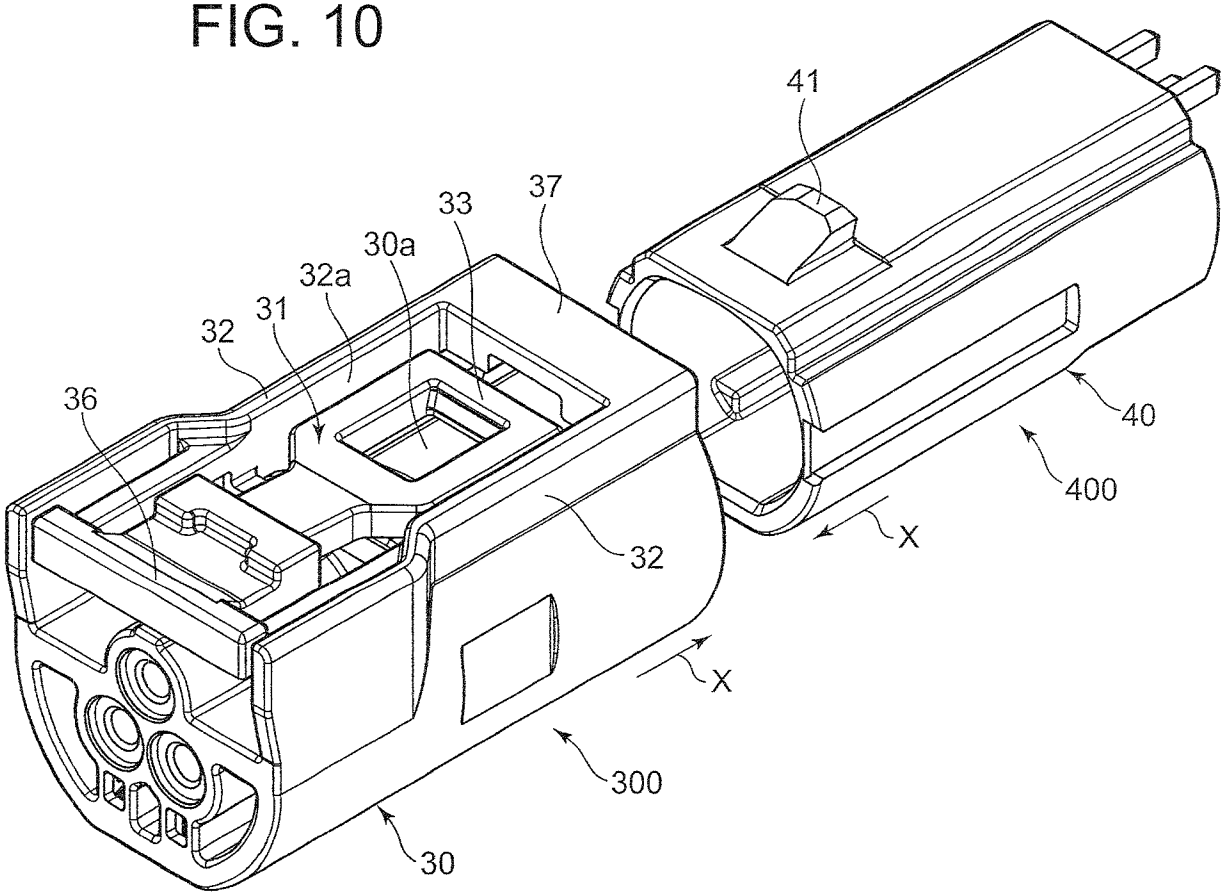
FIG. 10 is a perspective view of both the electrical connector in Embodiment 2 according to the present invention and a mating connector.

As shown in FIG. 10, when the electrical connector 300 and the mating connector 400, which are separated from each other, are moved in the coupling direction X to make them couple with each other, the locking part 33 of the lock arm 31 (of the electrical connector 300) abuts on the locking part 41 of the mating connector 400, and runs over it while sliding thereon. After that, the locking part 33 of the electrical connector 300 fits into the reverse side of the locking part 41 of the mating connector 400. In this way, the electrical connector 300 and the mating connector 400 are locked together.

On the other hand, as shown in FIG. 15 and FIG. 16, when the operating part 36 of the lock arm 31, which is located in the reverse side of the housing 30 of the electrical connector 300, is pressed toward the housing 30, the lock arm 31 swings like a seesaw utilizing the portions of the pair of projection pieces 34 and 34, and the leg parts 35 and 35 as fulcrums, and the locking part 33, which is located at a opposite position of the operating part 36, moves away from the outer periphery part 30*a* of the housing 30. When the pressing to the operating part 36 is released, the lock arm 31 returns to the original state (a state shown in FIG. 9 and FIG. 12) according to elastic restoring force of the pair of projection pieces 34 and 34 and the leg parts 35 and 35.

Accordingly, when the electrical connector 300 and the mating connector 400 shown in FIG. 10 are coupled with each other and the operating part 36 of the lock arm 31 is pressed toward the housing 30, the locking part 33 of the lock arm 31 is released (as shown in FIG. 15 and FIG. 16) from the outer peripheral part 30*a* of the housing 30, and the electrical connector 300 and the mating connector 400 can be separated from each other.

According to the structure in the electrical connector 300 shown in from FIG. 9 to FIG. 16, even if the leg parts 35 and 35 are shortened so as to form the electrical connector 300 lower, the leg parts 35 and 35 and the pair of projection pieces 34 and 34 can be secured as a portion for elastically deforming as a fulcrum when the lock arm 31 swings like a seesaw. Therefore, stress concentration resulting from the shortening of the elastic deformation portion can be avoided, and settling of the lock arm can be also prevented. When the lock arm 31 swings like a seesaw, not only the leg parts 35 and 35 but also the pair of projection pieces 34 and 34 can be elastically deformed while being twisted. Excellent release operation of the lock arm 31 can be maintained, and this is also effective in preventing from the settling of the lock arm.

Both of the electrical connector 100 in Embodiment 1 and the electrical connector 300 in Embodiment 2 are mere examples of the present invention. The scope of the present invention is not limited to the electrical connectors 100 and 300 shown in from FIG. 1 to FIG. 16.

Having described preferred embodiments of the invention with reference to the accompanying drawings, it is to be understood that the invention is not limited to those precise embodiments, and that various changes and modifications may be effected therein by one skilled in the art without departing from the scope of the invention as defined in the appended claims.

INDUSTRIAL APPLICABILITY

The electrical connector according to the present invention can be widely employed as connecting means for cables in fields, such as automobile industry, electrical industry, mechanical industry, or the like.

BRIEF DESCRIPTION OF SYMBOLS

10, 20, 30 and 40: Housing
10*a* and 30*a*: Outer peripheral part
11 and 31: Lock arm
11*a* and 31*a*: Lower face part
12 and 32: Side wall part
12*a* and 32*a*: Inner side face
13, 21, 33 and 41: Locking part
14: Bridge part (elastic support mechanism)
14*b*: Bottom part
15 and 35: Leg part (elastic support mechanism)
16 and 36: Operating part
34: Projection piece (elastic support mechanism)
37: Bridge Part
X: coupling direction
Z: Predetermined distance
100 and 300: Electrical connector
200 and 400: Mating connector

What is claimed is:

1. An electrical connector, comprising:

a housing including an outer peripheral part; and a lock arm provided with the outer peripheral part, the lock arm being swingable like a seesaw and detachably engaging with a locking part provided with another housing of a mating connector, wherein:

the lock arm extends along a coupling direction toward the mating connector;

a pair of side wall parts are provided with the outer peripheral part such that the pair of side wall parts oppose to each other from both sides of the lock arm;

an elastic support mechanism for swingably supporting the lock arm is provided between a lower face part of the lock arm and inner side faces of the pair of side wall parts;

the pair of side walls project from the outer peripheral part of the housing to extend in a longitudinal direction of the housing; and the elastic support mechanism includes:

a plate shaped part swingably supporting the lock arm between the lower face part of the lock arm and the inner side faces of the pair of side walls; and a leg part having one end being connected to the plate shaped part, and another end being connected to the lock arm.

2. The electrical connector as defined in claim 1, wherein the elastic support mechanism further includes:

a bridge part capable of being elastically deformed, the bridge part being provided between the outer peripheral part of the housing and the lock arm so as to connect the pair of side wall parts; and a leg part connecting the lock arm and the bridge part.

3. The electrical connector as defined in claim 1, wherein the elastic support mechanism further includes:

a bridge part capable of being elastically deformed, the bridge part being provided between the outer peripheral part of the housing and the lock arm so as to connect the pair of side wall parts; and a plurality of leg parts connecting the lock arm and the bridge part.

4. The electrical connector as defined in claim 1, wherein the elastic support mechanism further includes:

a projection piece capable of being elastically deformed, the projection piece being provided between the outer peripheral part of the housing and the lock arm so as to project from one of the inner side faces of the pair of side wall parts; and a leg part connecting the lock arm and the projection piece.

* * * * *